US005759089A

United States Patent [19]

McCoy

[11] Patent Number: 5,759,089

[45] Date of Patent: Jun. 2, 1998

[54] APPARATUS FOR IN-LINE SURFACE FINISHING OF CYLINDRICAL TUBING SUCH AS STAINLESS STEEL TUBING WITH SUPPORTING MANDREL AND METHOD

[76] Inventor: Thomas Edward McCoy, 467 Robinson Rd., Mooresville, N.C. 28115

[21] Appl. No.: 736,412

[22] Filed: Oct. 24, 1996

Related U.S. Application Data

[63] Continuation-in-part of Ser. No. 585,455, Jan. 16, 1996, Pat. No. 5,658,187.

[51] Int. Cl.[6] ..... B24B 1/00

[52] U.S. Cl. ..... 451/49; 451/188; 451/184

[58] Field of Search ..... 451/49, 50, 184, 451/185, 59, 60, 36, 37, 188, 131; 29/33 T, 33.5, 28, 156.62; 72/208, 214

[56] References Cited

U.S. PATENT DOCUMENTS

| | | | |
|---|---|---|---|
| 3,101,577 | 8/1963 | Skugghall . | |
| 3,518,796 | 7/1970 | Gawronski . | |
| 3,813,911 | 6/1974 | Bibighaus | 72/208 |
| 3,842,635 | 10/1974 | Bibighaus | 72/208 |
| 3,882,648 | 5/1975 | Buchinske et al. . | |
| 4,078,905 | 3/1978 | Oya . | |
| 4,794,684 | 1/1989 | Vanlauwe | 29/33 T |
| 5,245,793 | 9/1993 | Schmitz . | |

*Primary Examiner*—Timothy V. Eley
*Assistant Examiner*—Derris H. Banks
*Attorney, Agent, or Firm*—Adams Law Firm, P.A.

[57] ABSTRACT

A surface finishing apparatus for in-line outer surface finishing of elongate cylindrical tubing. The tubing, such as tubing, is fed onto an elongate mandrel and through the finishing apparatus from an infeed to an outfeed position and rotated on the mandrel on its longitudinal axis. The outer surface of the tubing is finish treated as the tubing is fed through the apparatus while being supported on the mandrel. The finishing apparatus includes a rotatable finishing wheel having a finish-treating peripheral surface for being applied in an in-line orientation against the outer surface of the tubing as the tubing is simultaneously fed and rotated through the finishing apparatus. The wheel is mounted on an axis of rotation which is variable within a predetermined range of motion from one side to the other of the longitudinal axis of the tubing and oscillates back and forth within the predetermined range of motion while in continuous contact with the tubing.

13 Claims, 12 Drawing Sheets

APPARATUS FOR IN-LINE SURFACE FINISHING OF CYLINDRICAL TUBING SUCH AS STAINLESS STEEL TUBING WITH SUPPORTING MANDREL AND METHOD

TECHNICAL FIELD AND BACKGROUND OF THE INVENTION

This application is a continuation-in-part of applicant's prior application Ser. No. 08/585,455, filed on Jan. 16, 1996 and entitled "APPARATUS FOR IN-LINE SURFACE FINISHING OF CYLINDRICAL STOCK SUCH AS STAINLESS STEEL TUBING, AND METHOD", now U.S. Pat. No. 5,658,187.

This invention relates to an apparatus for in-line surface finishing elongate cylindrical tubing, for example, stainless steel tubing, and a method for in-line surface finishing of cylindrical tubing such as stainless steel tubing. The application discloses the use of a mandrel used to support the tubing during the finishing process.

Use of the term "in-line" is used in this application to mean that the scratch pattern of the surface finish applied to the tubing extends substantially parallel to, or linearly along, the longitudinal axis of the tubing, in contrast to prior art radial finishing techniques wherein the scratch pattern extends generally radially around the surface of the tubing substantially perpendicular to the longitudinal axis of the tubing.

The invention will be described in this application with respect to in-line buffing the surface of stainless steel tubing to achieve a chrome-bright finish. Tubing finished in this manner has numerous mechanical and ornamental applications, including railing and ladders for boats, exterior vehicle accessories, and metal furniture structural pieces such as legs and arms. However, the principles of the invention have application in applying differing types of surface finishes to other types of tubing, pipe and solid cylindrical tubing.

The apparatus and process described comes near the end of a number of other prior art processes, the major ones being described briefly below.

In general, coiled stainless steel sheet between 18 inches and 60 inches wide and 5,000 feet long is slit into a strip which is as wide as the circumference of the tubing to be formed. For example, tubing having an O.D. of one inch will be slit into a strip 3.1416 inches wide. The strip is rolled back into a coil and taken to a tube mill. The tubing is formed by traversing the strip in a continuous process through a series of forming rollers. The initial stage is referred to as the "breakdown" stage, where the opposing edges are turned upwardly.

The strip is then passed to a "fin" section, where the opposing edges are gradually and progressively curved upwardly towards each other until the strip has been formed into a closed cylindrical tube with the opposing edges aligned with each other.

The tubing is passed through a welding machine where the two opposing edges are continuously welded to each other. The welded tubing then passes through a grinder where the weld is ground flush with the adjacent walls of the tubing. The tubing is then passed through a precision-sizing section where a series of precisely sized and aligned sizing rollers shape the tubing to its final size and cylindrical shape.

The tubing is then cut to a predetermined manageable length, for example, 30 feet, for further processing.

In some prior art processes, the tubing is then polished. "Polishing" is a term of art which means using progressively finer- grit sandpaper to put an initial smooth finish on the exterior surface of the tubing. The sandpaper is applied to the tubing as the tubing is rotated. Thus, a radial finish is applied to the tubing during this process. The scratch pattern formed during this process extends radially around the outer circumferential surface of the tubing and are quite easily seen when light is reflected off of the tubing. In relative terms, polishing applies a crude finish which is sufficient for some mechanical applications, but not for other mechanical applications, particularly when the tubing also serves an ornamental function. Tubing which is radially polished in the manner described above must also be radially buffed.

Prior art buffing is also carried out radially. The tubing is fed into a buffing machine while being rotated about its longitudinal axis. Large buffing wheels rotating about axes which are parallel to the longitudinal axis of the tubing are pressed against the outer circumferential surface of the tubing as it extends down the length of the machine. These wheels generally rotate in the range of 1,800–2,000 rpm. A typical prior art configuration would include four buffing wheels in axial alignment with each other and spaced approximately 3 feet apart. The wheels are generally either fabricated of sisal or cotton cloth or a combination of both, with all or predominately sisal wheels being used on the infeed end of the machine and the all or predominately cotton cloth wheels being used near the outfeed end. The fourth wheel is generally all cotton and is referred to as a "fluffy wheel." Various types of buffing compounds are periodically applied to the wheels during operation, and it is the buffing compound and not the wheel from which the material is made which actually performs the buffing process. The sisal or cotton acts primarily as a carrier for the buffing compound.

Friction creates a temperature at the outfeed position of approximately 4000° F. An advantage of the prior art radial buffing process is that the tubing can be very evenly buffed on all surfaces while the tubing is supported. Thus, warping of the tubing is minimal.

When properly carried out, this buffing process applies a final chrome-bright finish to the tubing resembling a chrome-plated finish. However, light striking the tubing at particular angles reveals the radial scratch pattern necessarily applied during the process. This scratch pattern gives the tubing a "look" which many end users find less than ideal, and which can create a distinct contrast with adjacent, short lengths of tubing which have been hand buffed, or are chrome-plated.

Prior efforts have been made by applicant and others to buff stainless steel tubing linearly or "in-line" with the longitudinal axis of the tubing using wheels such as used for radial buffing. To applicant's knowledge all such efforts have failed, and there is presently no known commercial manufacture of stainless steel tubing or other cylindrical tubing wherein a buffed finish is applied "in-line."

The apparatus and method disclosed in this application buffs stainless steel tubing "in-line" at commercial speeds to a chrome bright finish which exhibits a highly desirable ornamental appearance.

In accordance with the improvement of this application, it has been found that the incorporation of an elongate mandrel into the apparatus to support the tubing while it is being buffed greatly enhances the efficiency of the system.

SUMMARY OF THE INVENTION

Therefore, it is an object of the invention to provide an apparatus for in-line surface finishing elongate cylindrical tubing while supporting the tubing on a mandrel.

It is another object of the invention to provide an apparatus for in-line buffing stainless steel tubing.

It is another object of the invention to provide an apparatus for buffing stainless steel tubing without applying a radial scratch pattern to the outer surface of the tubing.

It is another object of the invention to provide an apparatus for buffing stainless steel tubing which operates a speeds compatible with other commercial stainless steel tubing manufacturing steps.

It is another object of the invention to provide an apparatus for buffing stainless steel tubing wherein the tubing is supported on an elongate mandrel during finishing, wherein the mandrel is configured to permit easy placement of the tubing onto the mandrel for finishing.

It is another object of the invention to provide an apparatus for buffing stainless steel tubing wherein the tubing is supported on an elongate mandrel during finishing, wherein the mandrel includes latching means for permitting the tubing to be easily placed on the mandrel.

It is another object of the invention to provide a method for in-line surface finishing of cylindrical tubing such as stainless steel tubing which achieves the objects set out above.

These and other objects of the present invention are achieved in the preferred embodiments disclosed below by providing a surface finishing apparatus for in-line outer surface finishing of elongate cylindrical tubing, comprising feed means for feeding a length of tubing through the finishing apparatus from an infeed to an outfeed position, elongate mandrel means for being positioned within the tubing and supporting the tubing along the length of the tubing during passage of the tubing from the infeed position to the outfeed position, rotating means for rotating the tubing around the longitudinal axis of the mandrel means as the tubing is fed through the finishing apparatus; and finishing means for finish-treating the outer surface of the tubing as the tubing is fed through the apparatus.

According to one preferred embodiment of the invention, the mandrel means comprises a first elongate segment adjacent the infeed end having a predetermined outside diameter less than the internal diameter of the tubing, and a second elongate segment adjacent the outfeed end having a predetermined outside diameter greater than the diameter of the first segment and less than the internal diameter of the tubing.

According to another preferred embodiment of the invention, the first and second elongate mandrel segments are connected together end-to-end in concentric relation, and wherein the mandrel means includes a tapered transition between the diameters of the first and second mandrel segments.

According to yet another preferred embodiment of the invention, feed means are provided for feeding a length of tubing through the finishing apparatus from an infeed to an outfeed position, elongate mandrel means are provided for being positioned within the tubing and supporting the tubing along the length of the tubing during passage of the tubing from the infeed position to the outfeed position, rotating means are provided for rotating the tubing around the longitudinal axis of the mandrel means as the tubing is fed through the finishing apparatus, and finishing means are provided for finish-treating the outer surface of the tubing as the tubing is fed through the apparatus. Preferably, the finishing means comprises a rotatable finishing wheel having a finish-treating peripheral surface for being applied in an in-line orientation against the outer surface of the tubing as the tubing is simultaneously fed and rotated through the finishing apparatus, the wheel being mounted on an axis of rotation which is variable within a predetermined range of motion from one side to the other of the longitudinal axis of the tubing; and oscillating means cooperating with the finishing wheel for oscillating the finishing wheel back and forth within the predetermined range of motion while in continuous contact with the tubing.

According to one preferred embodiment of the invention, the surface finishing apparatus comprises a plurality of finishing means positioned at spaced-apart intervals between the infeed position and the outfeed position.

According to another preferred embodiment of the invention, the oscillating means for each of the respective plurality of finishing wheels oscillates the finishing wheel randomly from each of the other finishing wheels in order to apply a randomized, non-repeating finish to the tubing.

According to yet another preferred embodiment of the invention, each of the finishing wheels is vertically positioned above the tubing for being applied against an upper semi-cylindrical surface of the rotating tubing.

Preferably, the invention includes adjustment means for adjusting the vertical position of each finishing wheel relative to the tubing.

According to yet another preferred embodiment of the invention, guide means are positioned along the length of the finishing apparatus between the infeed position and the outfeed position for positioning and maintaining the tubing in finishing position in relation to the finishing wheels.

According to yet another preferred embodiment of the invention, compound applicator means are provided for applying a surface-finishing compound to the finishing wheels for application to the surface of the tubing.

According to yet another preferred embodiment of the invention, latching means are provided for cooperating with the mandrel for retaining the mandrel in a stationary position relative to the tubing moving through the finishing apparatus.

According to another preferred embodiment of the invention, said latching means is movable from a finishing position wherein the mandrel is held stationary relative to the tubing moving through the finishing apparatus and a loading position wherein the tubing can be placed over the mandrel and moved into position for finishing on the finishing apparatus.

According to yet another preferred embodiment of the invention, said latching means comprises a swing arm pivotally mounted for movement into and out of engagement with said mandrel; and a latch pin carried by said swing arm for being positioned in a hole formed in said mandrel for maintaining the mandrel in a stationary position while the tubing is being finished, and removed from said hole while tubing is being loaded onto the mandrel.

An embodiment of the method of surface finishing tubing according to the invention comprises the steps of feeding tubing onto a supporting mandrel, buffing the outer cylindrical surface of the tubing with a succession of finishing wheels to a chrome-bright finish, wherein a scratch pattern is applied to the surface of the tubing during the buffing process extending along the longitudinal axis of the tubing.

According to one preferred embodiment of the invention, the buffing step comprises the steps of applying a rotating buffing wheel having a peripheral buffing surface positioned in an in-line orientation to the tubing against the outer surface of the tubing as the tubing is simultaneously fed and rotated through the buffing apparatus, oscillating the buffing wheel back and forth within a predetermined range of motion while in continuous contact with the tubing.

According to another preferred embodiment of the invention, the buffing step comprises the step of successively applying a plurality of buffing wheels to the surface of the tubing at spaced-apart intervals between the infeed position and the outfeed position.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

DESCRIPTION OF PRIOR ART TUBING

MANUFACTURING PROCESSES

Figure 1:
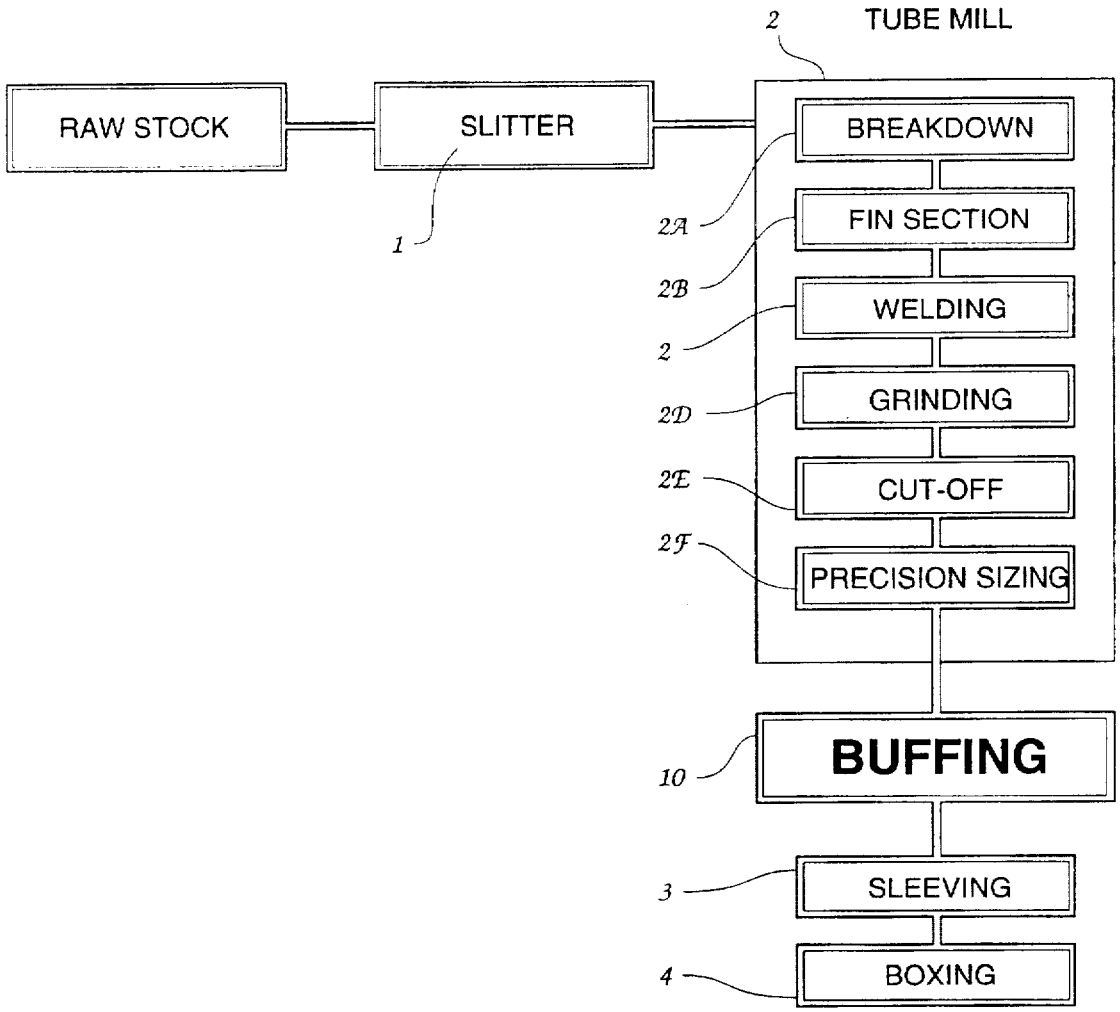
FIG. 1 is a flow diagram of a process for manufacturing stainless steel tubing which includes the buffing process according to the present invention.

Referring now specifically to the drawings, a manufacturing process for stainless steel tubing which incorporates a buffing apparatus and method according to a preferred embodiment of the present invention is illustrated in FIG. 1. As described in more detail in the Background of the Invention portion of the application, the manufacturing process includes taking raw tubing stock in the form of a relatively wide coil of stainless steel sheet, for example, Type 304 stainless steel strip, and slitting the sheet on a slitter 1 into a width which will form a stainless steel tube of desired diameter. The slit steel is backwound onto a core to form a coil of desired width. The slit steel is processed through a Tube Mill 2, where the steel is passed through Breakdown and Fin sections 2A and 2B where the sheet is rolled into a tube-shaped structure. The adjacent edges of the structure are welded together at a Welding section 2C, and the weld is ground off flush with the outer surface of the tubing in the Grinding section 2D. The tubing is cut to length in a Cut-Off section 2E, and then precision-sized in a Precision-Sizing section 2F.

GENERAL DESCRIPTION OF INVENTION

The present process according to the present invention takes place downstream from the processes described above. In accordance with the present invention, the sized stainless steel tubing is buffed to a chrome-bright finish on a buffing apparatus 10. Thereafter, the buffed tubing is sleeved to protect its finish at a sleeving station 3, and boxed for shipment at a boxing station 4. The remainder of the disclosure of this application relates to the buffing apparatus 10.

Figure 2:
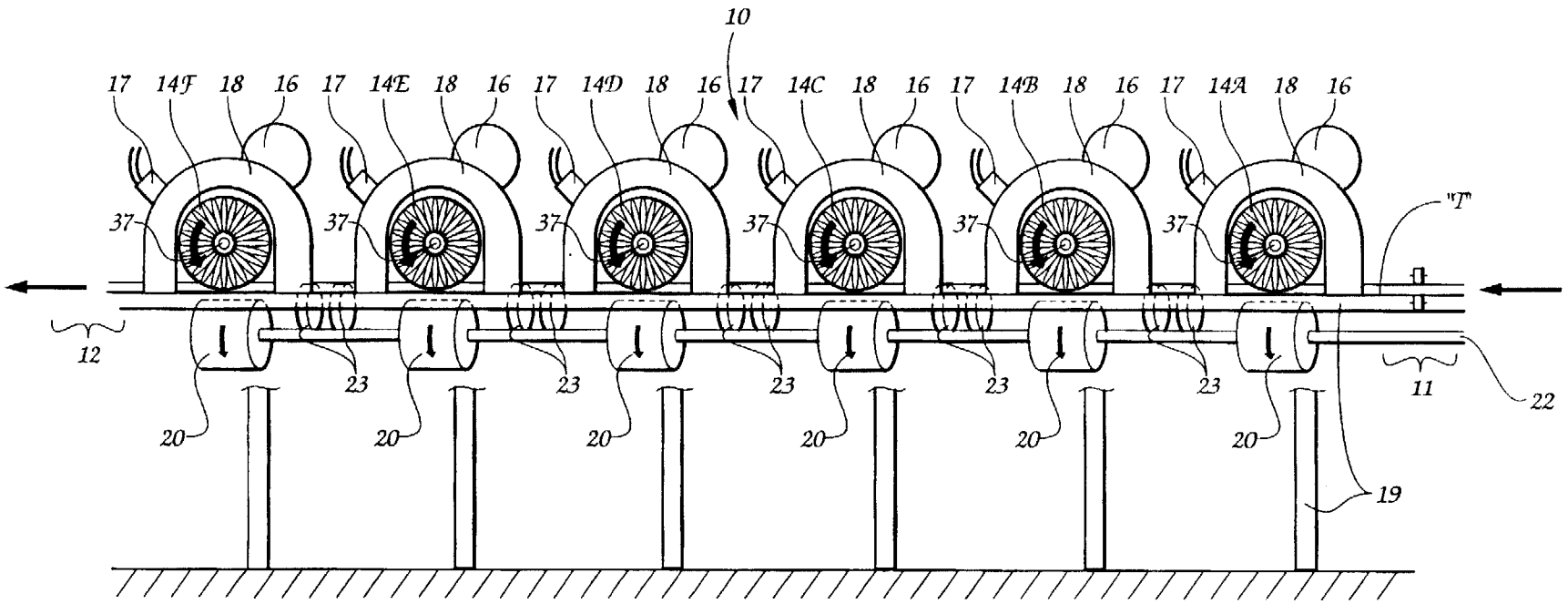
FIG. 2 is a simplified front elevation of a buffing apparatus according to an embodiment of the present invention.

Referring now to FIG. 2, the buffing apparatus 10 is shown in simplified form. Stainless steel tubing "T" is passed through the apparatus 10 from an infeed end 11 to an outfeed end 12. In the particular embodiment 10 shown in FIG. 2, buffing wheels 14A–14F 10 are positioned at 6 buffing stations spaced along the length of the buffing apparatus 10. However, other numbers and arrangements of buffing wheels are also possible within the scope of this application. With the exception of the characteristics of the buffing compound and the compound-carrying material of the buffing wheels 14A–14F, which vary, they function identically. Therefore, detailed explanation of the operation of the buffing wheels 14A, 14B, 14C, 14D, 14E and 14F proceeds with reference to the buffing wheel 14A, it being understood that the explanation applies as well to the other buffing wheels and the other apparatus components which cooperate with the buffing wheels and the tubing "T" to apply the proper finish.

DETAILED DESCRIPTION OF PREFERRED EMBODIMENT OF INVENTION

With continued reference to FIG. 2, the tubing "T" passes under the six buffing wheels 14A–14F while both the tubing "T" and the buffing wheels 14A–14F rotate. The buffing wheels 14A–14F are composed of materials, such as sisal fiber and cotton cloth, which carry buffing compound and assist the compound in applying a progressively finer scratch pattern to the tubing "T" as it proceeds through the buffing apparatus 10 from the infeed end 11 to the outfeed end 12. The buffing wheels 14A–14F are made up of subassemblies of relatively thin discs of material on the order of ½ inch thick which are ganged together coaxially to make buffing wheel 14A on the order of 4 inches wide.

Motors 16, described in further detail below, drive each of the buffing wheels 14A–14F, and buffing compound is applied to the rotating buffing wheels 14A–14F by a dispensing nozzle 17 at each of the buffing wheels 14A–14F. The buffing compound is metered onto the buffing wheels 14A–14F in precise quantities, and is applied to the tubing "T"0 by the sisal and/or cotton material of the buffing wheels 14A–14F. The buffing wheels 14A–14F are spaced approximately 2½ feet apart down the length of the buffing apparatus 10.

The buffing wheels 14A–14F rotate in the direction of travel of the tubing "T"-clockwise as shown in FIG. 2. The rotation of the buffing wheels 14A–14F is "in-line" or "linear" with respect to the longitudinal orientation of the tubing "T", with the axis of rotation of the buffing wheels 14A–14F being essentially perpendicular to the direction of travel of the tubing "T" through the buffing apparatus 10. During operation, each of the buffing wheels 14A–14F is enclosed under a protective sheet metal cover 18. An access door (not shown) can be removed for access to the buffing wheels 14A–14F, as shown in FIG. 2. The metal cover 18 and access door are removed from the buffing wheels 14A–14F in FIGS. 3–7 for clarity.

Figure 3:
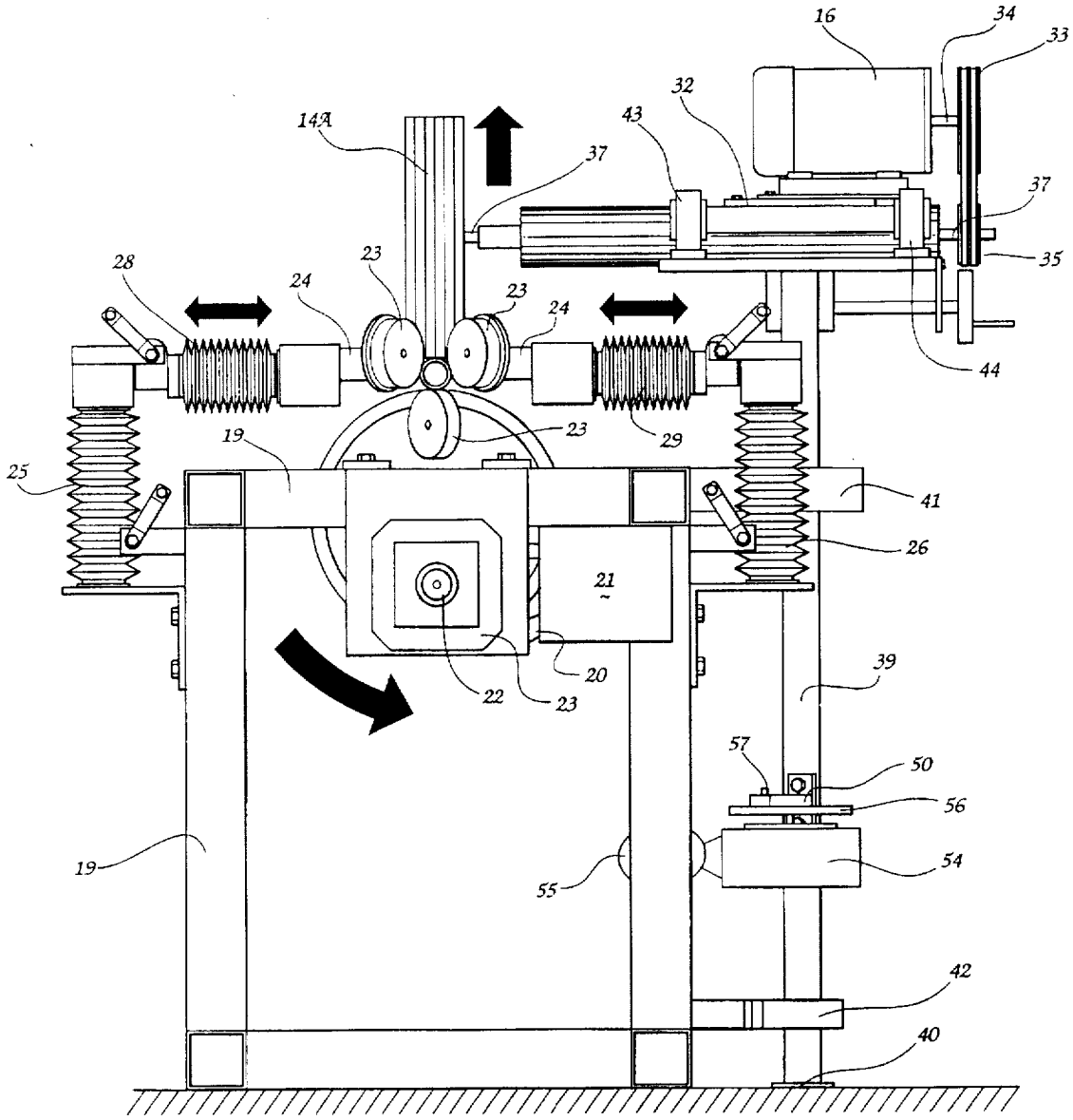
FIG. 3 is a end elevation of a buffing apparatus according to an embodiment of the present invention.

Referring now to FIG. 3, buffing apparatus 10 is shown in an end elevation, and is described with reference to buffing wheel 14A as representative of each of the buffing wheels 14A–14F. Each of the buffing wheels 14A–14F and associated components comprise a "buffing station", so that the buffing apparatus 10 has 6 buffing stations.

The buffing apparatus 10 includes an elongate table 19 on which the other parts of the buffing apparatus 10 are mounted. The tubing "T" is fed into the buffing apparatus 10 by a large-diameter, rubber-covered, driven infeed drive roller 20 mounted on table 19. Additional drive rollers 20 extend at intervals along the length of the table 19, as is best shown in FIG. 2. The drive rollers 20 are positioned below the buffing wheels 14A–14F. Drive rollers 20 are driven by a motor 21 which rotates a drive shaft 22 through a gear reducer 23. Motor 21 may, for example, be a ¾ HP electric motor with a 40/1 gear reducer which will rotate tubing "T" at 20 rpm.

One inch diameter tubing is fed into buffing apparatus 10 at a rate of 10 ft/min, with the infeed speed being reduced as the diameter of the tubing "T" is increased. For example, 2 inch diameter tubing is preferably fed into apparatus 10 at ft/min.

Drive rollers 20 are canted on drive shaft 22 in the direction of rotation, so that rotation causes the surface of drive rollers 20 to pull the tubing "T" into the apparatus 10 and along the length of the table 19. Drive shaft 22 extends the length of the table 19 and is made up of a series of shaft segments joined by universal joints so that the canted arrangement of the drive rollers 20 described above can be repeated, as described below.

The tubing "T" is rotated about its longitudinal axis by surface-to-surface contact between the surface of drive rollers 20 and the tubing "T".

The correct position of the "T" is established and maintained by a series of canted caster rollers 23 which are positioned to each side, on top of and below the tubing "T" along the length of the table 19. The side caster rollers 23 are mounted on adjustment rails 24 which have limited movement along the length of the table 19 and permit the degree of cant to be adjusted. The adjustment rails extend along the length of the table 19. This same system is utilized in prior art polishing processes to keep the tubing being polished centered as it is being polished. Thus, detailed explanation in unnecessary.

As described above, the tubing "T" is centered on the tube rotation drive roller 22 by caster wheels 23. The caster wheels 23 are vertically adjustable by respective screw actuators 25 and 26 and horizontally adjustable by respective screw actuators 28 and 29.

Thus, the drive roller 20 rotates the tubing "T" by surface-to-surface contact, while the caster wheels 23 maintain proper orientation of the tubing "T" on the drive roller 20.

Referring now to motor 16, which drives the buffing wheel 14A, motor 16 is mounted on a motor platform 32. Preferably, motor 16 is a 5 HP induction motor rotating at 1715 rpm, for example, a Siemens Standard TEFC Type RGZ. A drive pulley 33 rotated by the shaft 34 of the motor 16 rotates a pulley 35 mounted on an arbor 37. The arbor 37 is also mounted on the motor platform 32 and carries the buffing wheel 14A on its opposite end. The motor platform 32 is carried on top of a tubular steel support pedestal 39. The pedestal 39 is supported on a thrust bearing 40 and attached to the table 19 by pillow block bearings 41 and 42.

Figure 4:
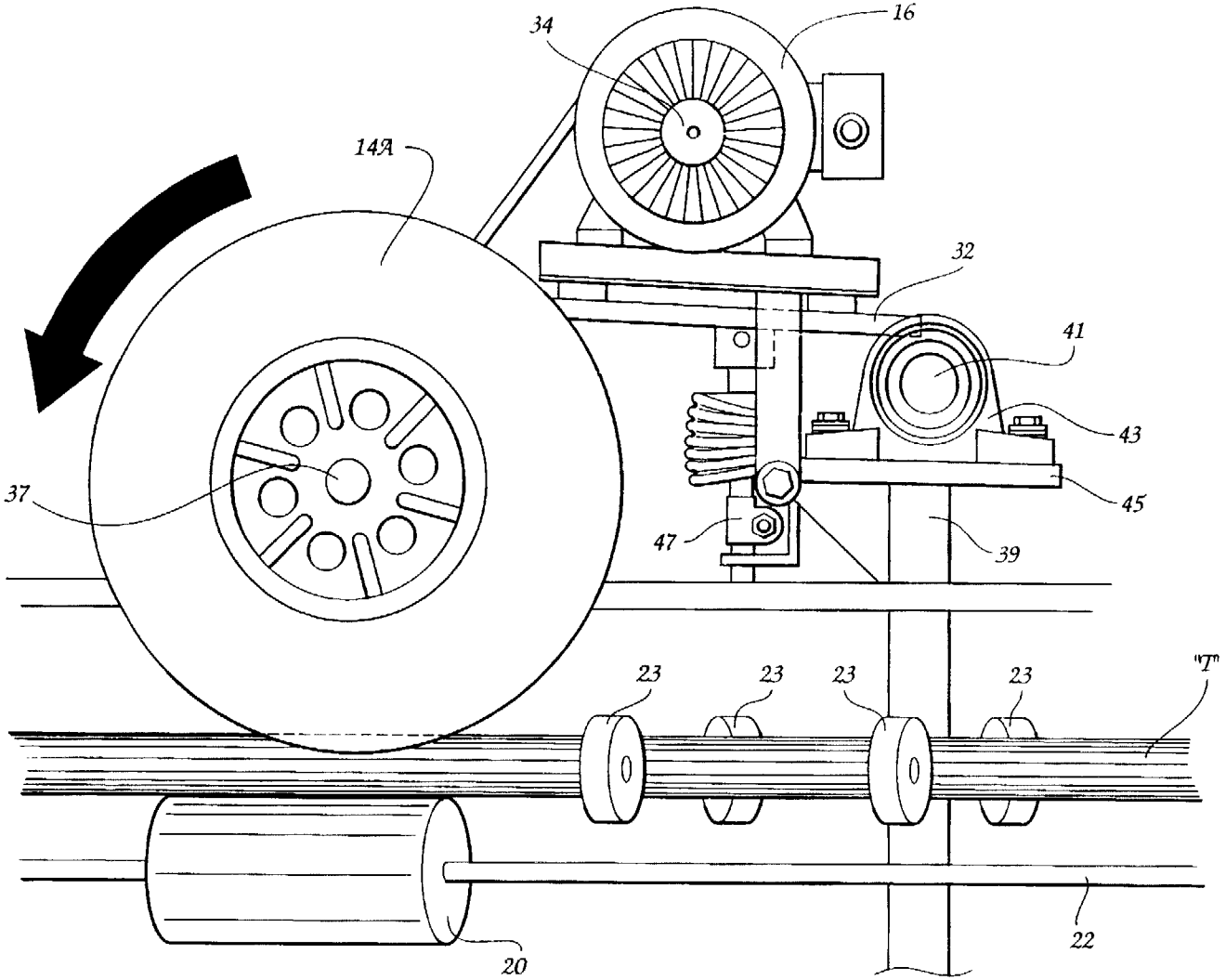
FIG. 4 is a fragmentary front elevation of a buffing apparatus according to an embodiment of the present invention.
Figure 5:
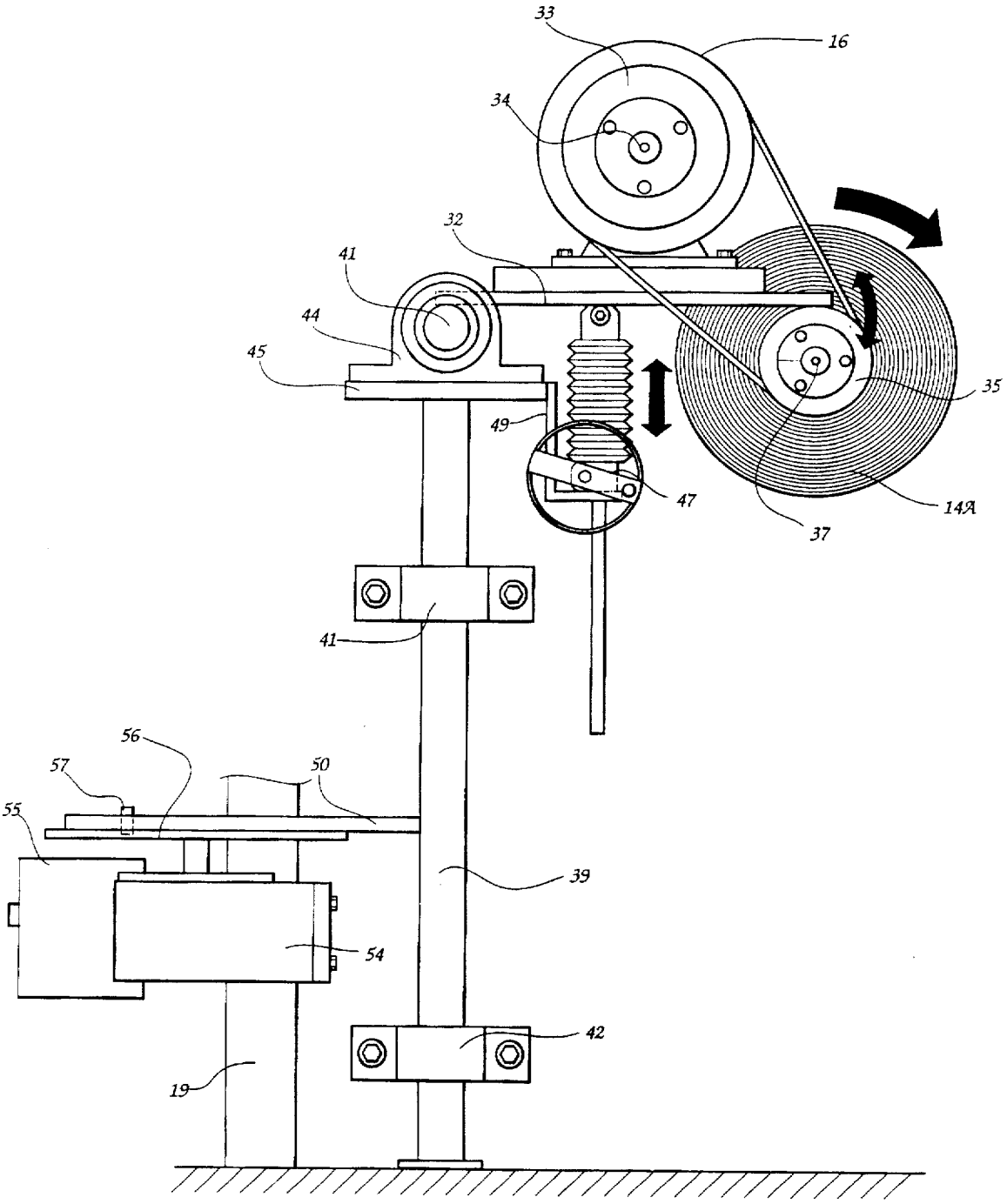
FIG. 5 is a fragmentary elevation of the oscillating mechanism of the buffing apparatus disclosed in the application.

Referring now to FIGS. 4 and 5, the drive system for the buffing wheel 14A is shown in more detail. One edge of motor platform 32 is welded to an axle 41 which rotates within a pair of axle bushings 43, 44. The axle bushings 43, 44 are mounted on the top surface of a support plate 45 carried on top of the pedestal 39. The edge of the motor platform 32 therefore forms a pivot axis for vertical movement of the motor 16.

Vertical movement of the motor platform 32 and thus the motor 16 is achieved by use of a screw actuator 47 which is carried on a bracket 49 welded to the side of the support plate 45. The weight of the motor 16, the motor platform 32 and the arbor 37 is sufficiently great that some adjusting mechanism such as the screw actuator 47 must be used to position the buffing surface of the buffing wheel 14A in proper buffing contact with the top surface of the rotating tubing "T." As the buffing surface of the buffing wheel 14A is worn away, the screw actuator 47 is used to gradually lower the motor platform 32 to maintain proper contact with between the tubing "T" and buffing surface of the buffing wheel 14A. The proper positioning of the buffing wheel 14A in relation to the tubing "T" is discussed in greater detail below under the heading "Operation of Buffing Apparatus 10."

A key aspect of proper buffing of the tubing "T" in accordance with the invention is the prevention of repeating or distinctive patterns appearing on the tubing "T". It is also critically important that heat buildup in the tubing "T" during buffing on the buffing apparatus 10 be uniform, so that the tubing "T" does not warp. These objects are achieved by oscillating the buffing wheels 14A–14F as buffing takes place. Oscillation of the buffing wheels 14A–14F results from the reciprocation of the pedestal 39. The pedestal 39 supports the motor 16 and the buffing wheel 14A. Thus, the reciprocation of the pedestal 39 causes the buffing wheel 14A to oscillate across the top surface of the tubing "T".

Figure 6:
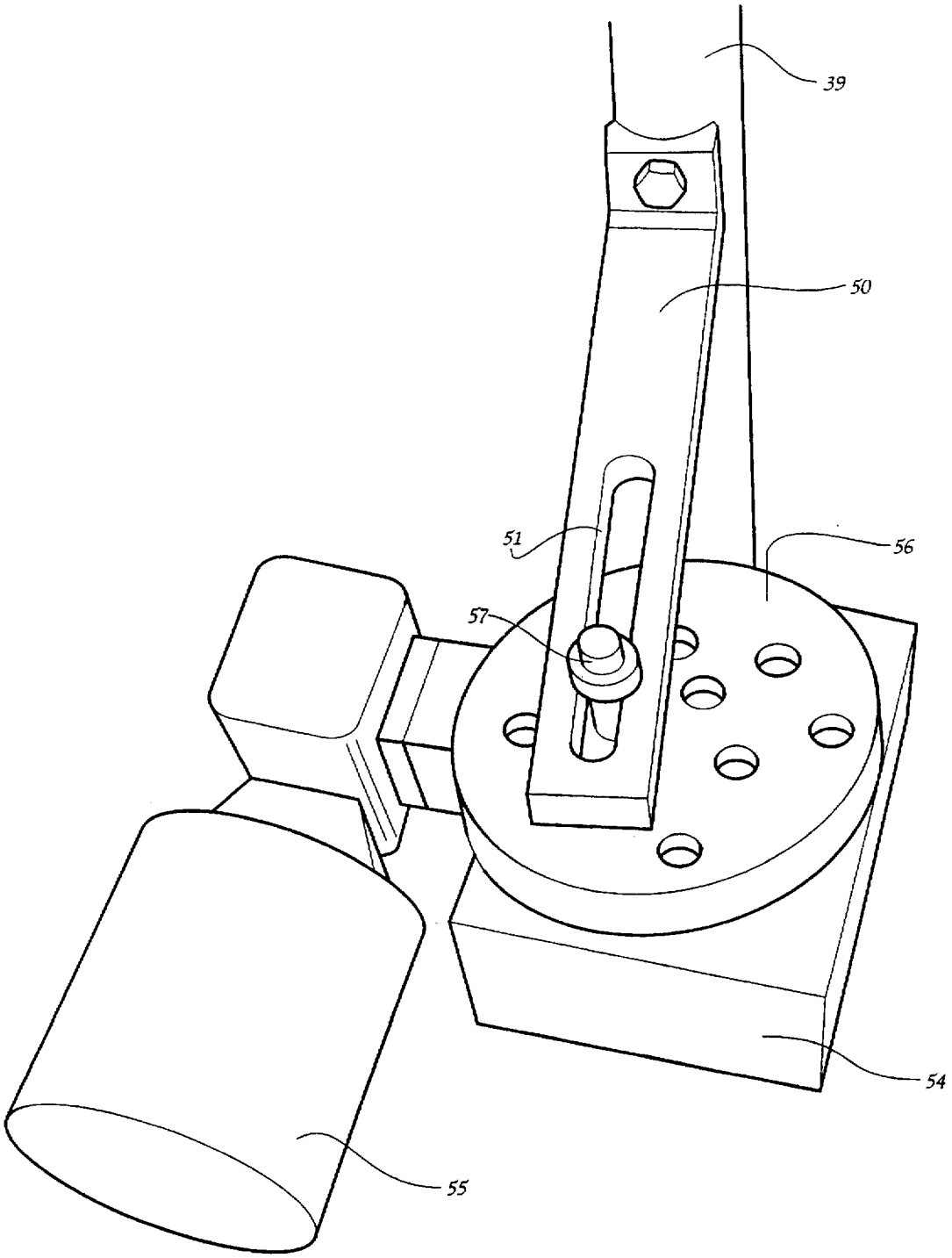
FIG. 6 is an enlarged, fragmentary perspective view of a portion of the oscillating mechanism shown in FIG. 5.

Referring again to FIG. 5, and to FIG. 6, an oscillator arm 50 is welded to the pedestal 39. Oscillator arm 50 includes an elongate slot 51 along its length. A double gear reduction box 54 is mounted on one of the legs of table 19 and reduces the input rpm of a motor 55, such as a ½ HP motor down to the desired oscillation rate. A drive wheel 56 carries an upwardly-extending, eccentrically-mounted shoulder bolt 57 which rides in the slot 51. As drive wheel 56 rotates, the shoulder bolt 57 reciprocates along the length of the slot 51, causing the oscillator arm 50 to oscillate back and forth.

The movement of the oscillator arm 50 causes the pedestal 39 and thus the motor 16 and the buffing wheel 14A to oscillate at the same rate. A preferred oscillation rate for buffing one inch stainless steel tubing is 24 strokes/min.–12 strokes in each direction.

In a preferred embodiment of the invention, the width of the buffing wheel surface of each of the buffing wheels 14A–14F is 4 inches. Thus, it is preferable to oscillate the buffing wheels 14A–14F so that the buffing surfaces traverse the top of the tubing "T" from one side to the other. In other words, the buffing wheels 14A–14F will oscillate approximately 4 inches off of the centerline of the tubing "T" in each direction of oscillation. This promotes even wear of the buffing surfaces of the buffing wheels 14A–14F.

OPERATION OF BUFFING APPARATUS 10

Figure 7:
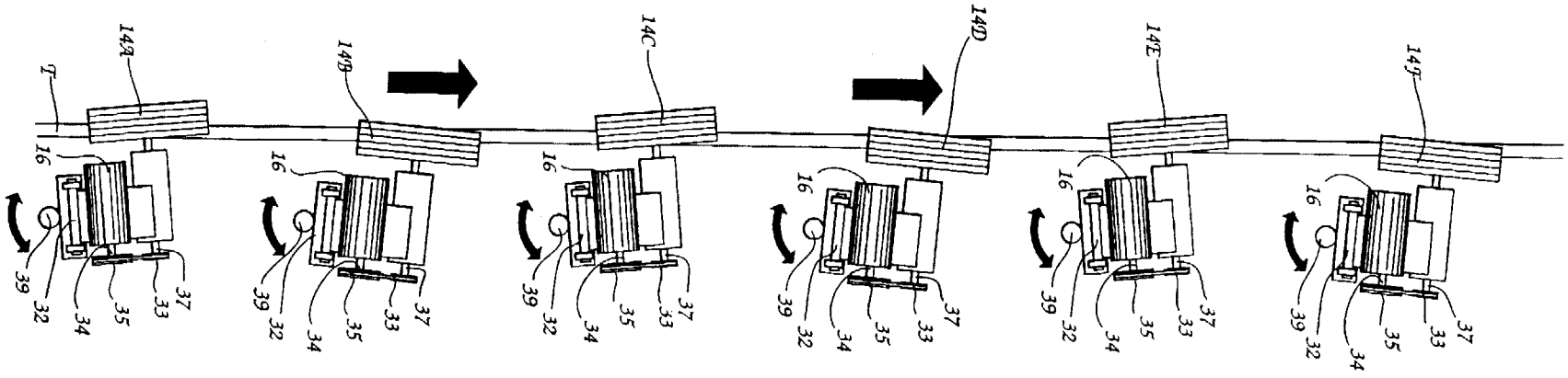
FIG. 7 is a simplified top plan view of an embodiment of the buffing apparatus according to an embodiment of the invention, illustrating the random oscillation of the buffing wheels.

Referring now to FIG. 7, the operation of buffing apparatus 10 described above is illustrated. As is seen, each of the buffing wheels 14A–14F is oscillating back and forth across the top of the tubing "T" as the tubing "T" rotates and is moved along the length of the buffing apparatus 10 from the infeed end 11 to the outfeed end 12. It is believed that the random scratch pattern desirable for producing a high quality chrome-bright finish is best achieved by oscillating the buffing wheels 14A–14F randomly from each other. As disclosed above, each of the buffing wheels 14A–14F have their own motors 16 and oscillation mechanisms. Thus, numerous minute variations in motor speed, friction, starting positions and the like will combine to produce a motion of each of the buffing wheels 14A–14F across the top surface of the tubing "T" which is random in relation to each of the others.

As a less desirable alternative, the oscillation movement can be produced from a single drive mechanism by ganging the oscillation mechanisms together, but positioning the buffing wheels 14A–14F so that they are at different points in the oscillation cycle at any given time. Other variations such as altering the location of each of the shoulder bolts 57 on the buffing wheels 14A–14F to cause oscillation at different rates may also produce acceptable results.

The speed of rotation of the buffing wheels 14A–14F is also varied. Buffing wheels 14A–14C preferably rotate at approximately 1800–2000 rpm. A cutting compound is applied to the buffing surfaces of the buffing wheels 14A–14C as the initial step in applying the buffed finish. The buffing wheels 14A–14C are preferably 100% sisal fiber.

Buffing wheels 14D–14E also rotate at approximately 1800–2000 rpm, are preferably a combination of sisal fiber and cotton fabric and apply a brightening compound.

Buffing wheel 14F rotates at approximately 800–1200 rpm, is preferably an all-cotton fabric "fluffy wheel", and applies a final highlighting compound.

As described, the tubing "T" is subjected to simultaneous linear travel, rotation and buffing which is essentially parallel to the axis of travel of the tubing "T". The oscillation of the buffing wheels 14A–14F causes a variation of several degrees which assists in randomizing and varying the scratch pattern so that light is evenly reflected off of the surface of the tubing "T". For this reason, and the absence of a radial scratch pattern caused by radial buffing or polishing, a very high quality finish can be applied to the tubing "T".

The simultaneous linear travel, rotation and in-line buffing of the tubing "T" also causes an even build-up of heat as the buffing process takes place. The temperature of the tubing "T" approaches 400° F. as the buffing process is completed. It is believed that the in-line buffing provides a more gradual and uniform increase in temperature than is the case with radial polishing or buffing. This is surprising, since the buffing wheels 14A–14F are engaging the tubing "T" from the same vertical orientation.

Figure 8:
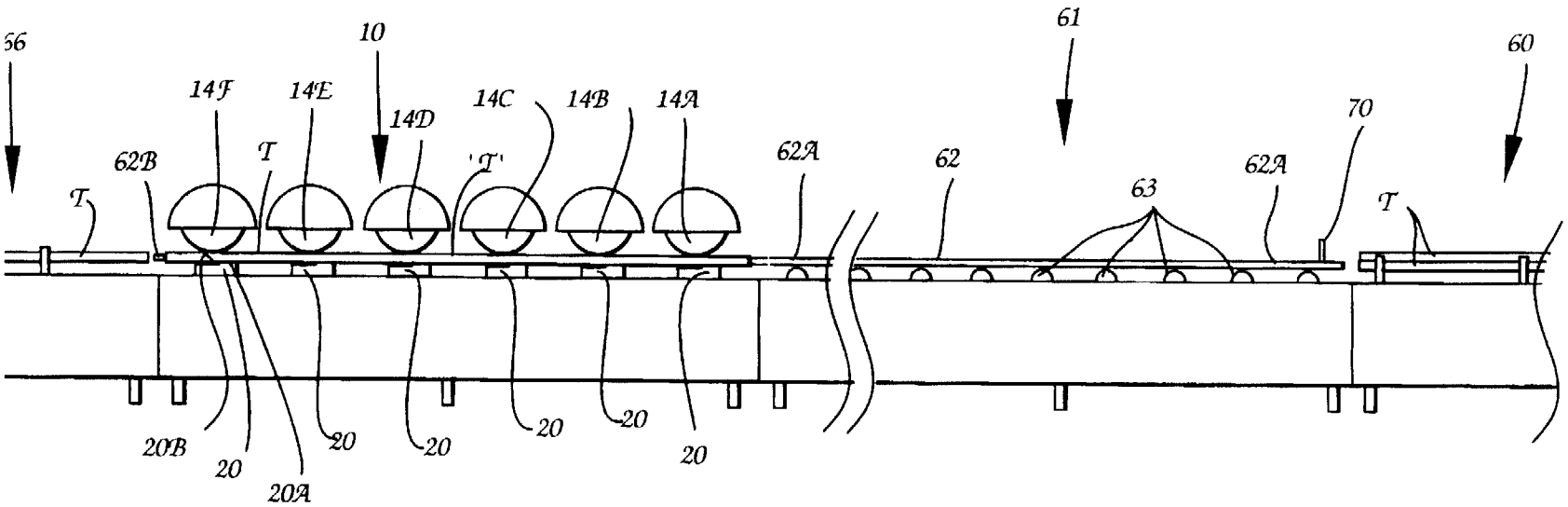
FIG. 8 is a simplified side elevation of the finishing apparatus, including unbuffed tube storage, tube loading, tube buffing and buffed tube storage areas.

It has been found that further enhancement to the apparatus and method is achieved by utilizing a mandrel to support the tubing "T" during the finishing process. Referring now to FIG. 8, the buffing apparatus 10 is shown as part of a processing line which includes an unbuffed tube storage stand 60 where tubing "T" ready for buffing are stored. Downstream from the tube storage stand 60 is a tube loading stand 61 on which is supported a mandrel 62 by a series of spaced-apart guide rollers 63. The mandrel 62 extends the length of the tube loading stand 61 and extends onto and along the length of the buffing apparatus 10, as well. As the buffed tubing exits the buffing apparatus 10 it is loaded onto a buffed tube storage stand 66 for storage until it is sleeved and packed for shipment.

The lengths of the various elements of the processing line are dependant on the length of the tubing being buffed, the processing speed and other variables. By way of example, a typical buffing apparatus 10 may be 17 feet long. In this example, the mandrel 62 may be formed of bar or tubing having a total length of approximately 51 feet. In the example shown in FIG. 8, the mandrel is formed by concentrically joining two mandrel segments 62A and 62B. The tapered transition 62C can be formed by the weldment used to connect the two segments 62A and 62B together.

Figure 9:
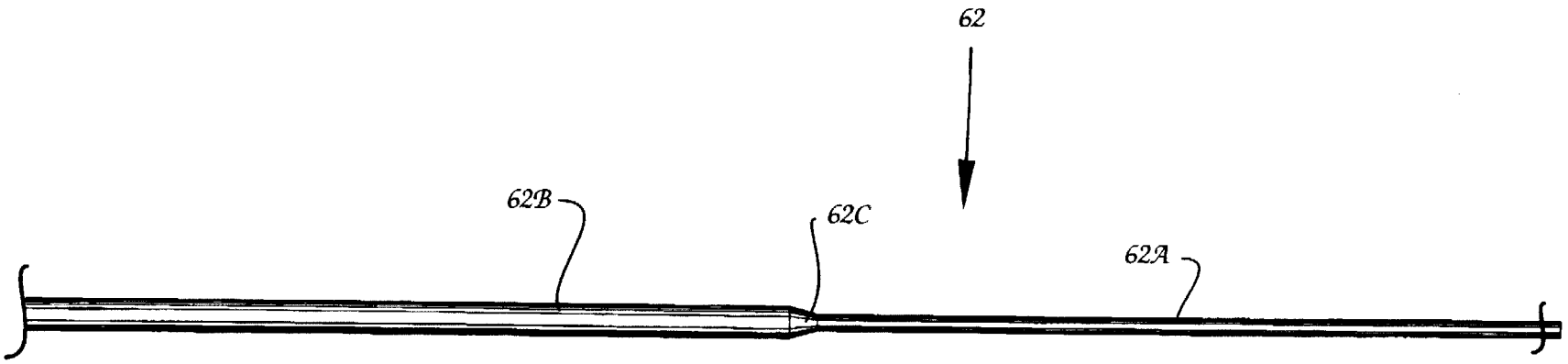
FIG. 9 is a fragmentary view of the mandrel.

As is shown in FIG. 9, the mandrel segment 62A is smaller in diameter than the mandrel segment 62B. A tapered transition 63C permits easy movement of the tubing lengths "T" along the length of the mandrel 62 from the mandrel segment 62A to the mandrel segment 62B.

The diameter of the mandrel segments 62A and 62B varies depending on the diameter of the tubing "T" being buffed. For example, if buffing 2-inch diameter stainless steel tubing "T", the upstream mandrel segment 62A is 1½ inch in diameter and the downstream mandrel segment 62B is 1¾ inch in diameter. The smaller diameter segment 62A provides easier loading of the tubing "T" onto the mandrel 62 and reduced friction between the mandrel 62 and the inside of the tubing "T". Once the tubing reaches the buffing apparatus 10, the transition to the larger diameter mandrel segment 62B reduces the speed of rotation of the tubing as the buffing takes place and reduces any tendency of the tubing to wobble during rotation.

The mandrel segments 62A and 62B also prevent the buffing wheels 14A–14F from slinging the tubing off linearly off of the end of the apparatus 10. In addition, the buffing wheels 14A–14F tend to force buffing compound into the downstream end of the tubing during the buffing process. Excess amounts must be manually removed after buffing has been completed. The mandrel 62 fills a significant portion of the tubing and greatly reduces the amount of compound which collects in the ends of the tubing during buffing.

Figure 10:
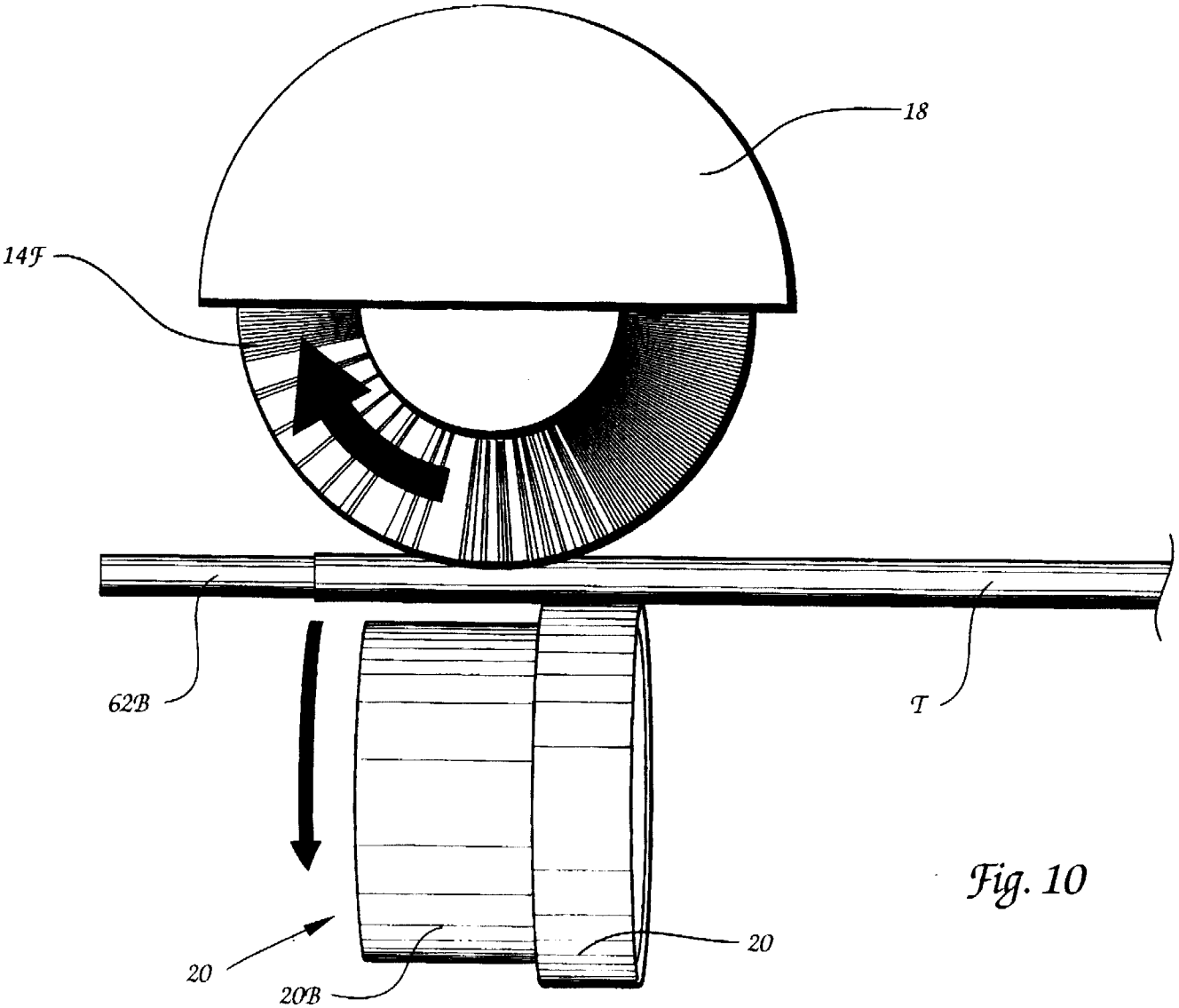
FIG. 10 is a fragmentary, enlarged simplified view of the outfeed end of the finishing apparatus showing how the tubing is supported as the last buffing step is carried out.

Referring now to FIG. 10, the downstream end of the mandrel segment 62B is supported by the downstream-most drive roller 20, which has two surface segments 20A and 20B. The upstream segment 20A has a larger diameter than the downstream segment 20B and is positioned to support the mandrel segment 62B and the tubing being buffed just upstream from where the final buffing wheel 14F applies the final finish to the tubing. Thus, contact with the drive roller segment 20B does not mar the mirror finish just applied to the tubing. However, the drive roller segment 20B will still prevent excessive downward deformation of the end of the mandrel segment 62B or the tubing as it exits the buffing apparatus 10.

Figure 11:
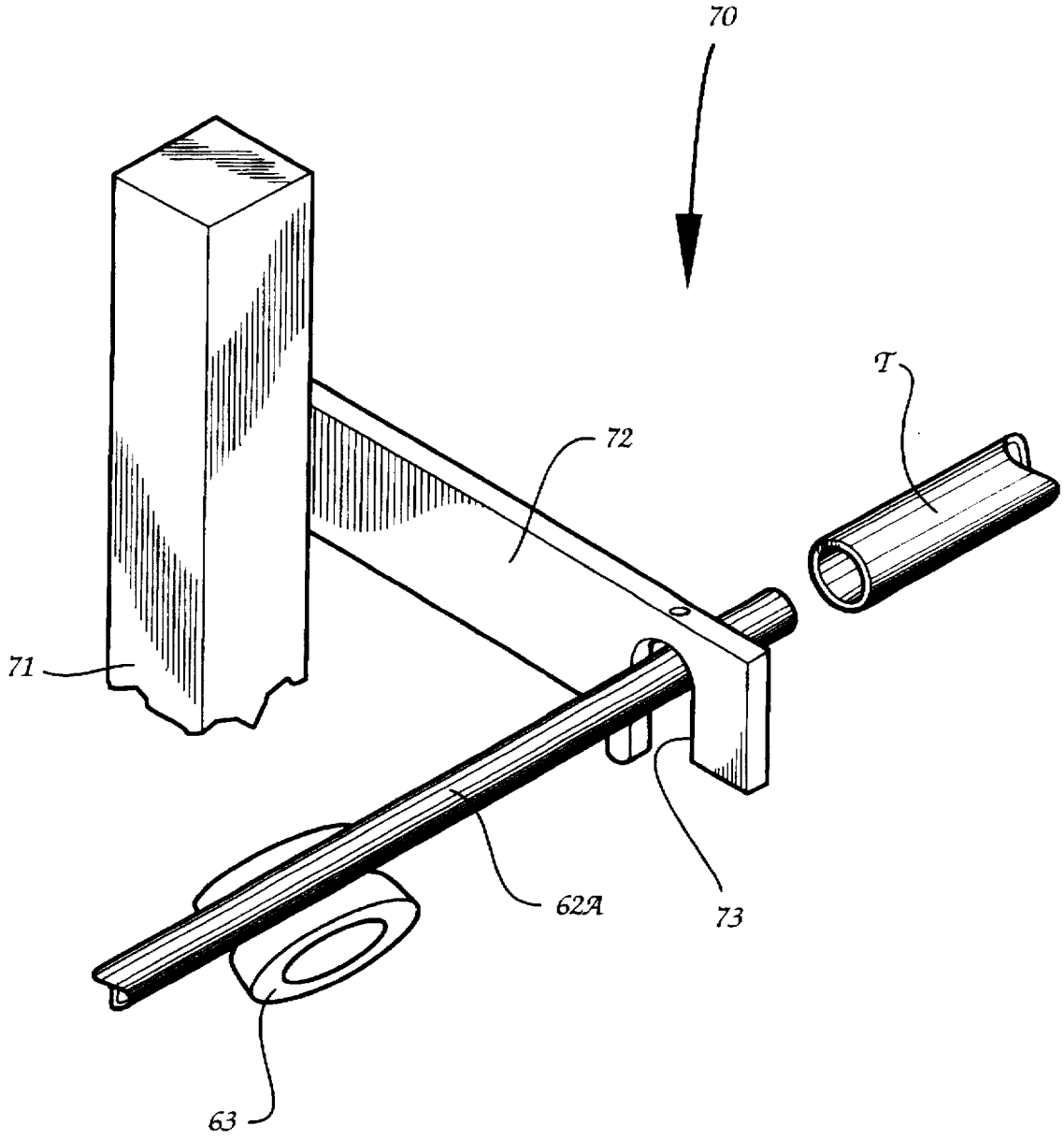
FIG. 11 is a fragmentary, simplified view of the latching means.
Figure 13:
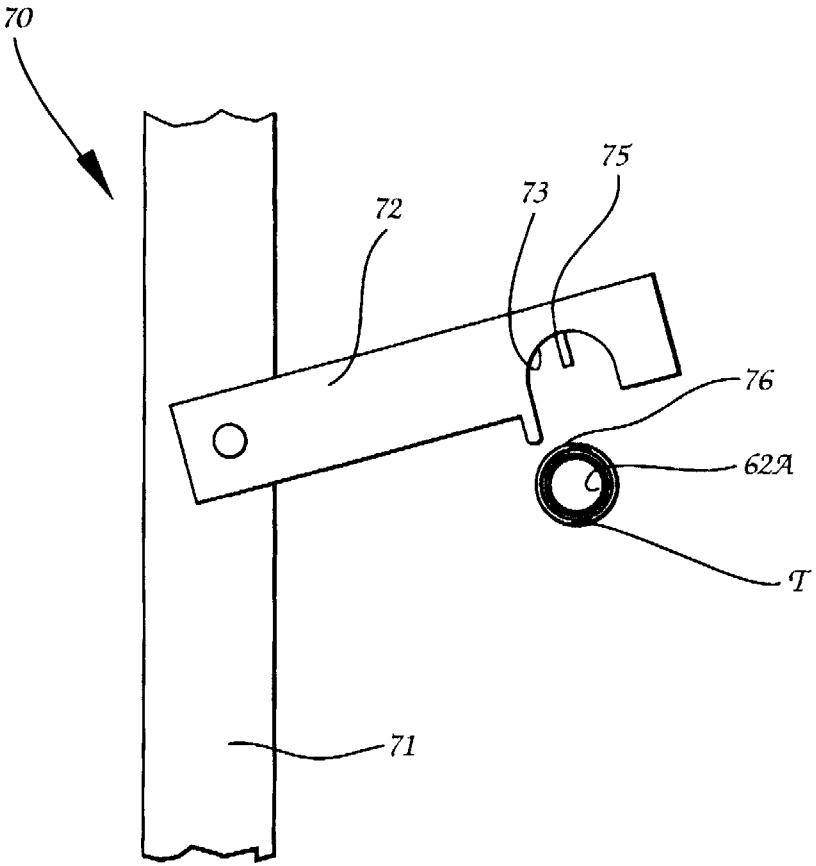
FIGS. 12 and 13 show the latching means in the tubing finishing and tubing loading positions.

Referring now to FIG. 11, a latching mechanism 70 is positioned at the upstream end of the tube loading stand 61 adjacent the downstream end of the unbuffed tube storage stand 60. See also FIG. 8. The latching mechanism 70 holds the mandrel 62 and prevents both rotational and linear movement of the mandrel 62 as the tubing is moved downstream through the buffing apparatus 10, as is shown in FIGS. 11, 12 and 13.

The latching mechanism 70 includes a support bar 71 which carries a pivotally mounted swing arm 72. The swing arm 72 includes a recess 73 formed in the swing arm 72, and is sized to fit over the mandrel segment 62A.

Figure 12:
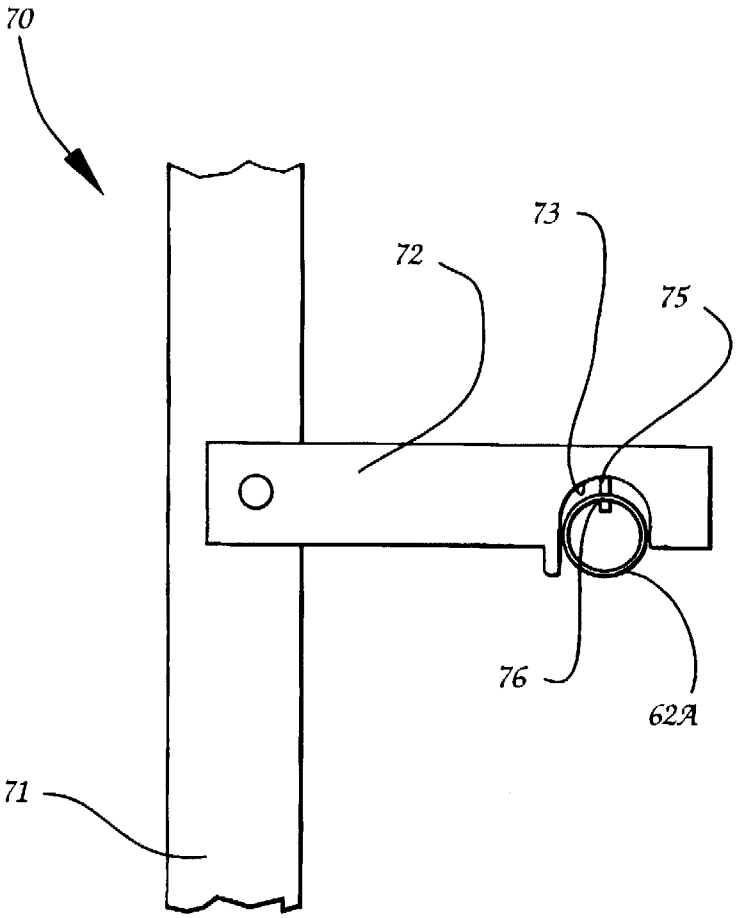

As is best shown in FIG. 12, a latch pin 75 is fixed in the upper end of the recess 73 and extends downwardly towards the mandrel segment 62A. A hole 76 in the mandrel segment 62A receives the latch pin 75 and holds the mandrel 62 stationary while the tubing "T" is being fed to the buffing apparatus 10. As is shown in FIG. 13, the swing arm 72 is raised and the latch pin 75 is withdrawn from the hole 76 in the mandrel segment 62A.

Referring now to FIG. 8 again, tubing "T" is stored on the unbuffed tube storage stand 60 in preparation for buffing. The unbuffed tubing is manually pulled from the storage stand 60 towards the upstream end of the tube loading stand 61. The swing arm 72 of the latching mechanism 70 is lifted, removing the latch pin 75 from the hole 76 in the mandrel segment 62A. With the pin removed and out of the way, the unbuffed tubing "T" is pushed onto the mandrel 62 and moved along the tube loading stand 60 until the entire length of tubing has been placed on the mandrel 62 and the trailing end of the tubing "T" has cleared the hole 76 of the latching mechanism 70. The latching pin 75 is then placed back in the hole 76, thereby preventing the mandrel 62 from being moved by the movement of the tubing "T" into the buffing apparatus 10.

By way of example, the tube loading stand 60 and the smaller diameter mandrel segment 62A is approximately 42 feet long, meaning that several lengths of unbuffed tubing "T" can be placed on the mandrel 62. The unbuffed tubing "T" is pushed manually along the mandrel 62 until it enters the buffing apparatus 10.

As buffed tubing "T" exits the downstream end of the buffing apparatus 10 it is placed onto a padded cradle (not shown in detail) carried by the buffed tube storage stand 66.**

A buffing apparatus and method is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A surface finishing apparatus for in-line outer surface finishing of elongate cylindrical tubing, comprising:

(a) feed means for feeding a length of tubing through the finishing apparatus from an infeed end to an outfeed end;

(b) elongate mandrel means for being positioned within the tubing and supporting said tubing along the length of the tubing during passage of the tubing from the infeed position to the outfeed position, wherein said mandrel means comprises:

(i) a first elongate segment adjacent an infeed end having a predetermined outside diameter less than the internal diameter of the tubing; and (ii) a second elongate segment adjacent an outfeed end having a predetermined outside diameter greater than the diameter of said first segment and less than the internal diameter of the tubing;

(c) rotating means for rotating the tubing around the longitudinal axis of the mandrel means as the tubing is fed through the finishing apparatus; and (d) finishing means for finish-treating the outer surface of the tubing as the tubing is fed through the apparatus, said finishing means including oscillating means cooperating with a surface finishing wheel for oscillating the finishing wheel back and forth within the predetermined range of motion while in continuous contact with the tubing, said oscillating means including pivot means for pivoting said finishing wheel about a single vertical pivot axis which extends from beyond one side of the longitudinal axis of the tubing to beyond the other side of the longitudinal axis of the tubing.

2. A surface finishing apparatus according to claim 1, wherein said first and second elongate mandrel segments are connected together end-to-end in concentric relation, and wherein said mandrel means includes a tapered transition between the diameters of the first and second mandrel segments.

3. A surface finishing apparatus for in-line outer surface finishing of elongate cylindrical tubing, comprising:

(a) feed means for feeding a length of tubing through the finishing apparatus from an infeed end to an outfeed end;

(b) elongate mandrel means for being positioned within the tubing and supporting said tubing along the length of the tubing during passage of the tubing from the infeed position to the outfeed position;

(c) rotating means for rotating the tubing around the longitudinal axis of the mandrel means as the tubing is fed through the finishing apparatus;

(d) finishing means for finish-treating the outer surface of the tubing as the tubing is fed through the apparatus, said finishing means comprising:

(i) a rotatable finishing wheel having a finish-treating peripheral surface for being applied in an in-line orientation against the outer surface of the tubing as the tubing is simultaneously fed and rotated through the finishing apparatus, said wheel being mounted on an axis of rotation which is variable within a predetermined range of motion from one side to the other of the longitudinal axis of the tubing; and (ii) oscillating means cooperating with the finishing wheel for oscillating the finishing wheel back and forth within the predetermined range of motion while in continuous contact with the tubing, said oscillating means including pivot means for pivoting said finishing wheel about a single vertical pivot axis which extends from beyond one side of the longitudinal axis of the tubing to beyond the other side of the longitudinal axis of the tubing.

4. A surface finishing apparatus according to claim 3, wherein said surface finishing apparatus comprises a plurality of finishing means positioned at spaced-apart intervals between the infeed position and the outfeed position.

5. A surface finishing apparatus according to claim 4, and including compound applicator means for applying a surface-finishing compound to the finishing wheels for application to the surface of the tubing.

6. A surface finishing apparatus according to claim 3, wherein the oscillating means for each of the respective plurality of finishing wheels oscillates the finishing wheel randomly from each of the other finishing wheels in order to apply a randomized, non-repeating finish to the tubing.

7. A surface finishing apparatus according to claim 3, wherein each of said finishing wheels is vertically positioned above the tubing for being applied against an upper semi-cylindrical surface of the rotating tubing.

8. A surface finishing apparatus according to claim 3, and including adjustment means for adjusting the vertical position of the finishing wheel relative to the tubing.

9. A surface finishing apparatus according to claim 3, and including guide means positioned along the length of the finishing apparatus between the infeed position and the outfeed position for positioning and maintaining the tubing in finishing position in relation to the finishing wheels.

10. A surface finishing apparatus according to claim 1 or 3, and including latching means cooperating with the mandrel for retaining the mandrel in a stationary position relative to the tubing moving through the finishing apparatus.

11. A surface finishing apparatus according to claim 10, wherein said latching means is movable from a finishing position wherein the mandrel is held stationary relative to the tubing moving through the finishing apparatus and a loading position wherein the tubing can be placed over the mandrel and moved into position for finishing on the finishing apparatus.

12. A surface finishing apparatus according to claim 11, wherein said latching means comprises:

(a) a swing arm pivotally mounted for movement into and out of engagement with said mandrel; and (b) a latch pin carried by said swing arm for being positioned in a hole formed in said mandrel for maintaining the mandrel in a stationary position while the tubing is being finished, and removed from said hole while tubing is being loaded onto the mandrel.

13. A method of surface finishing tubing comprising the steps of:

(a) feeding tubing onto a supporting mandrel, (b) buffing the outer cylindrical surface of the tubing with a succession of finishing wheels to a chrome-bright finish, wherein said finishing wheels randomly oscillate about a vertical axis relative to each other whereby a scratch pattern is applied to the surface of the tubing during the buffing process extending along the longitudinal axis of the tubing.

* * * * *